United States Patent [19]

Comerci

[11] Patent Number: 4,767,339

[45] Date of Patent: Aug. 30, 1988

[54] MODULAR FUSEBLOCK

[75] Inventor: Joseph D. Comerci, Elmhurst, Ill.

[73] Assignee: Littelfuse, Inc., Des Plaines, Ill.

[21] Appl. No.: 24,393

[22] Filed: Mar. 10, 1987

[51] Int. Cl.[4] ..... H01R 9/26

[52] U.S. Cl. ..... 439/716; 439/717

[58] Field of Search ..... 439/712, 713, 715–718, 439/709, 710, 719–722, 350–358, 368

[56] References Cited

U.S. PATENT DOCUMENTS

| | | | |
|---|---|---|---|
| 3,317,886 | 5/1967 | Norden | 439/717 |
| 3,970,276 | 7/1976 | Debaigt | 439/716 |
| 3,993,395 | 11/1976 | Taylor | 439/717 |
| 4,082,408 | 4/1978 | Angelis | 439/717 |
| 4,171,862 | 10/1979 | Krasser | 439/717 |
| 4,184,733 | 1/1980 | Schmeling | 439/717 |
| 4,221,455 | 9/1980 | Cairns et al. | 439/721 |

FOREIGN PATENT DOCUMENTS

| | | | |
|---|---|---|---|
| 590568 | 8/1977 | Switzerland | 439/717 |

*Primary Examiner*—Gil Weidenfeld
*Assistant Examiner*—Gary F. Paumen
*Attorney, Agent, or Firm*—Russell E. Hattis; Lawrence J. Bassuk

[57] ABSTRACT

A modular fuseblock furnishes dovetail joint grooves and ridges that are accessible from above on both sides of the fuseblock. This provides for interlocking or joining additional fuseblocks on either side of a panel mounted fuseblock without unfastening the mounted fuseblock. Pilot grooves and ridges extending upwardly respectively from the dovetail grooves and ridges aid in engaging the dovetail groove and ridge joint means. Locking tabs on the sides of the fuseblock body detent joined fuseblocks to maintain them fixed in vertical position and end walls that ride in vertical tracks in the two side walls of the fuseblock prevent intrusion to the fuse clips and electrical connections from the ends of the fuseblock. An adapter provides mounting the fuseblock on a channel member while using the dovetail joint grooves and ridges. The adapter mounts on the channel member through rotational movement, and the fuseblock mounts on the adapter through translational movement. Upstanding fingers on the top of the adapter latch into a port opening to the bottom of the fuseblock to fasten the fuseblock to the adapter.

18 Claims, 2 Drawing Sheets

MODULAR FUSEBLOCK

DESCRIPTION

BACKGROUND OF THE INVENTION

This invention relates generally to mounting electrical devices in side-by-side relation and particularly relates to fuse holders or fuseblocks that are joined in side-by-side relation to effect a unitary arrangement of sequential fuseblocks.

Known fuse holders or fuseblocks furnish a molded body of insulating material that carries a pair of spaced apart clips to receive the end caps or blades of a fuse. The body supplies a base that carries the clips and a wall or pair of walls upstanding from the sides of the base. The base and sidewalls insulate the fuse clips and associated electrical connectors of the fuseblock from other parts that could otherwise intrude thereabouts to prevent short circuits and electrical shock to personnel.

Many installations require plural fuses and fuseblocks, and for convenience modular fuseblocks often are mounted next to one another in a series of side-by-side relationships, preferably joined in a unitary structure.

U.S. Pat. No. 3,993,395 to Taylor discloses a fuseblock structure constructed and arranged to engage with an adjacent fuseblock of like construction and become joined therewith through mating pairs of downwardly opening dovetail recesses or pockets and upwardly directed dovetail prongs. One side of the fuseblock will present the pair of dovetail pockets and the other side will present the pair of dovetail prongs. Slipping the two pockets down onto the two prongs then will join together the two fuseblocks in a unitary structure. The fuseblock of this patent furnishes a single sidewall extending above the pair of pockets with the one sidewall of one fuseblock forming a barrier between the fuses, clips and connectors of two joined fuseblocks. A separate sidewall member having a like pair of pockets provides the last end wall for the joined series of fuseblocks.

U.S. Pat. No. 4,082,408 to Angelis discloses a similar fuseblock structure having, however, a pair of sidewalls and only one downwardly opening dovetail pocket on one sidewall and one upwardly directed prong arranged on the opposite side wall. Again, the fuseblocks are joined by slipping the pocket down on the prong, both the pocket and prong being centrally located on the sides of the fuseblock.

A problem arises, however, with this downwardly opening pocket and prong arrangement. When one or more fuseblocks are fastened on a flat panel, additional fuseblocks cannot readily be joined to the series of fuseblocks on the side presenting the pocket or pockets; the downwardly opening pocket is not accessible from the side or from above to slip an upwardly directed prong therein. This requires that most if not all the fuseblocks be un-fastened from the flat panel to which they are attached. The upwardly directed prong of the additional fuseblock then must be joined with the downwardly directed pocket or pockets of the end fuseblock, and all of the fuseblocks must be re-fastened to the panel with the previously removed screws. This procedure wastes time and consumes labor.

Adding another fuseblock on the side or end with the exposed prong or prongs occurs by simply slipping the pocket or pockets down on the exposed prong or prongs and then fastening the fuseblock to the panel with an additional screw. The side of the fuseblock with the exposed prong or prongs, however, often is unavailable when the prong or prongs abut a cabinet wall or extend to the edge of the available space for the fuseblocks. In the field or in the factory, joining a fuseblock to an existing fuseblock or joined assembly of fuseblocks thus can be an expensive operation.

In addition to mounting fuseblocks on a flat panel, fuseblocks also have been mounted on channel members. The channel members typically furnish a base plate, fastened to an underlying support with such as screws, and a pair of upstanding rails of standard configuration or configurations. For mounting, the bottom front lip of the fuseblock engages with an edge of the front or lower rail, and the fuseblock rotates backwardly to snap a bottom back lip into engagement with an edge of the back or upper rail. The fuseblock exerts a force against the rails positively to fix the fuseblock in position along the channel member. This force typically results from the dimensions between the lips being slightly less than the dimensions between the engaged edges of the rails and the channel member compressing or torquing the fuseblock material to express the force.

U.S. Pat. No. 3,245,029 discloses a terminal block assembly for flat base or channel mounting. The disclosed assembly furnishes an end section and a terminal section that slide and nest against one another on the channel rails. The two sections are fastened in side-by-side nested relationship by screw clamps engaging the rails of the channel member.

A problem with the previously described fuseblocks and this last described terminal block assembly mounted on a channel member is the absence of simple joint structure for joining fuseblocks together, side-by-side in a unit on a channel member. Rotation of a fuseblock to mount the same on a channel member appears to preclude a vertical straight dovetail joint. Sliding fuseblocks together along a channel member also appears to preclude a vertical dovetail joint. Yet a need exists for some joint structure that can be used to join plural fuseblocks into a unit for flat panel and channel member mounting. A universal fuseblock design incorporating such a joint structure then could replace several different fuseblock designs presently required to obtain the described flat panel and channel member mountings.

SUMMARY OF THE INVENTION

In overcoming these and other problems, the invention furnishes a joint structure constructed and arranged for joining together like fuseblocks on either side thereof by operation of a simple, rectilinear, vertical movement of the one fuseblock onto the other.

In one preferred embodiment, the fuseblock comprises a body and a pair of sidewalls upstanding along the sides of the body. A pair of fuse clips mount on the top surface of the body for securing a fuse therein. The outside surfaces of the sidewalls carry the joint structure.

The joint structure supplies a pair of dovetail grooves vertically arranged on the outside surface of one sidewall and a pair of dovetail ridges vertically arranged on the outside surface of the other sidewall. The grooves and ridges of like fuseblocks are spaced and aligned to mate with one another by vertically sliding the fuseblock selectively in an upward or downward translational or rectilinear motion. The mated dovetail grooves and ridges then secure the fuseblocks together laterally. Because they are equally accessible from above and below on both sides of the fuseblock body, the grooves and ridges can be used to join together fuseblocks on both sides of any one mounted fuseblock. This eliminates having to remove a series of mounted fuseblocks to add one fuseblock.

For ease of manufacture, the dovetail grooves and ridges preferably extend from about the bottom surface of the body to only about the height of the top surface of the body to minimize the draft required for removing the fuseblock from a mold. This obtains a joint structure that lets adjacent fuseblocks rest flat or flush on a mounting panel. Grooves and ridges that extended fully the height of the body and sidewalls would need substantial draft for removing the fuseblock from a mold, and grooves and ridges having a large draft would lift adjacent joined fuseblocks from being flush with a mounting panel.

To aid in sliding the dovetail grooves or ridges of one fuseblock into engagement with the mating dovetail ridges or grooves of another fuseblock, each dovetail groove opens upwardly into a pilot groove and each dovetail ridge converges upwardly in a pilot ridge. The pilot ridges and pilot grooves extend upwardly the height of the sidewalls and guide or direct the joint structure of one fuseblock into engagement with the joint structure of another fuseblock.

The joint structure spaces the grooves and ridges towards the ends of the base to spread any stresses induced into the grooves and ridges away from each other and across the length of the body. This achieves a stronger fuseblock.

The invention further furnishes an adapter specifically constructed and arranged to achieve mounting the fuseblock of the invention on a channel while joining together adjacently mounted fuseblocks. In a preferred embodiment, the adapter has a central portion, a channel member engagement lower portion and a body engagement upper portion. The channel member engagement lower portion presents a configuration complementary to that of a channel member and mounts thereon by simple rotation.

The body engagement upper portion conforms to the configuration of the bottom surface of the fuseblock body and additionally, preferably, furnishes a pair of upstanding engagement fingers that can fit into a port opening to the bottom of the fuseblock body. The tips of the fingers have side extending latching surfaces that engage against like latching surfaces in the port mechanically to secure the fuseblock to the adapter. The fuseblock mounts on the adapter by simple vertical translational movement that provides for simultaneous joining of adjacent fuseblocks through the mating dovetail grooves and ridges and associated pilots previously described.

DESCRIPTION OF THE PREFERRED EMBODIMENT

Figure 1:
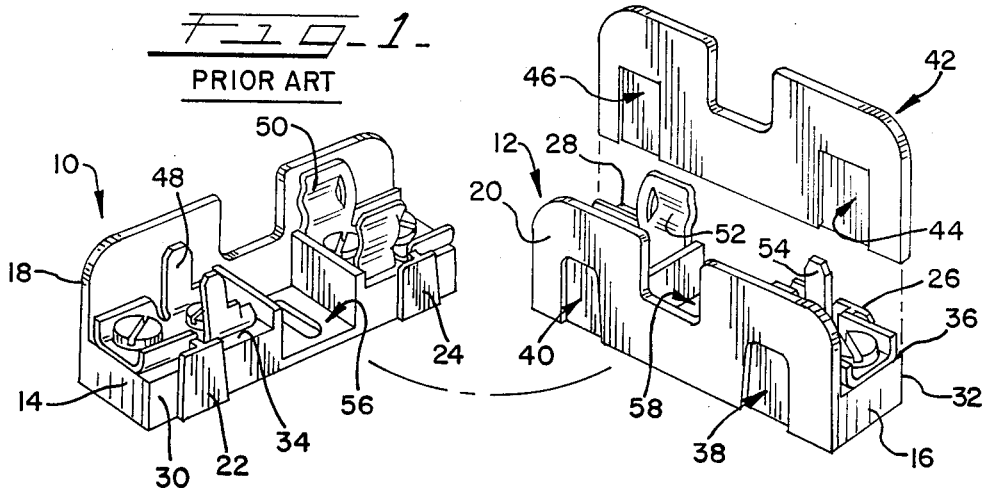
FIG. 1 PRIOR ART
FIG. 1 is a perspective view of a pair of prior art fuseblocks disclosed and claimed in U.S. Pat. No. 3,993,395.

In FIG. 1, known fuseblocks 10 and 12 comprise body portions 14 and 16 and single sidewalls 18 and 20. Each fuseblock has a pair of prongs 22, 24 and 26, 28 molded to the sides 30 and 32 of the body portions 14 and 16 and extending above the top surfaces 34 and 36 of the body portions 14 and 16.

Each sidewall 20 includes a pair (only one can be seen) of downwardly opening pockets 38, 40 with the height of each pocket extending above the top surface 36 of the body portion 16 of the fuseblock. An additional or separate sidewall member 42, required to complete an assembly, includes a pair of pockets 44 and 46 dimensioned the same as pockets 38 and 40.

Fuseblock 12 is joined to fuseblock 10 by vertically aligning the upwardly extending prongs 22, 24 and the downwardly opening pockets 38, 40 and lowering the fuseblock 12 thereupon to engage pockets 38, 40 over the prongs 22, 24. Sidewall member 42 joins to fuseblock 12 in a similar manner by vertically aligning pockets 44, 46 with prongs 26, 28 and translationally moving wall member 42 downwardly. This results in fuseblocks 10 and 12 being joined together against lateral forces and with three sidewalls upstanding from the body portions of the fuseblocks to protect against accidental intrusion and contact with any fuse, fuse connectors and electrical connections associated with the fuseblocks.

Each fuseblock includes a pair of fuse clips 48, 50 and 52, 54 for retaining cartridge fuses therein. Each fuseblock also includes a downwardly opening port 56 and 58 by which the fuseblock can be secured to a panel with any desired fastener such as a headed screw (not shown).

One drawback of the structures of fuseblocks 10 and 12 is that when fuseblock 12 is fastened to a panel the downwardly opening pockets 38 and 40 cannot be entered by the upwardly directed prongs of another fuseblock. Fuseblock 10 can be joined thereto along sidewall 20 only by unfastening fuseblock 12 from the panel, moving fuseblock 10 and fuseblock 12 relative to one another to engage the respective prongs and pockets thereof and re-fastening the two fuseblocks to the desired panel. Fuseblock 10 cannot be joined to fuseblock 12 along sidewall 20 without unfastening fuseblock 12 from the panel to which it is fastened. Fuseblock 10 could be readily joined to fuseblock 12 along side 32 of fuseblock 12 in place of sidewall member 42.

Figure 2:
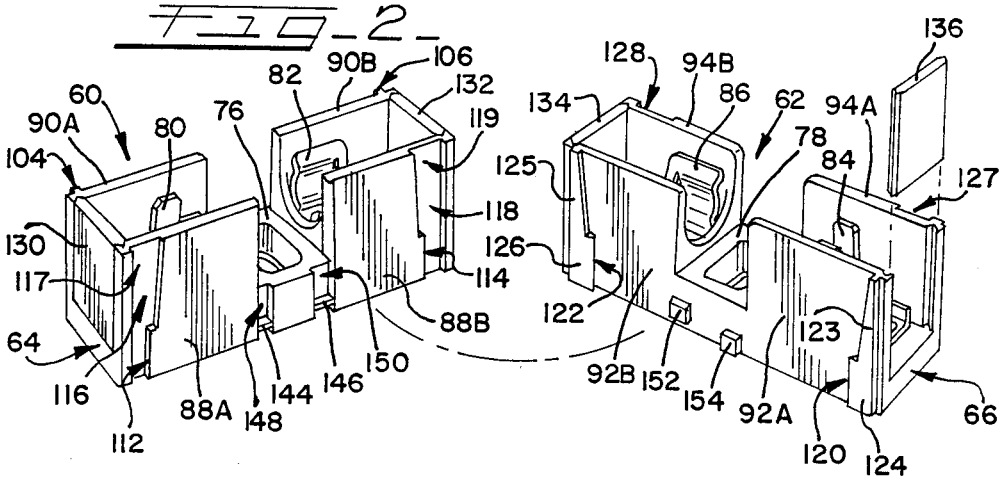
FIG. 2 is a perspective view of a pair of fuseblocks of the invention.
Figure 3:
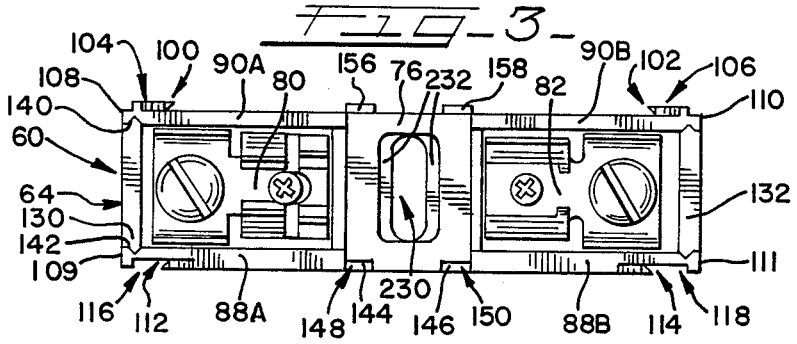
FIG. 3 is a plan view of one of the fuseblocks of the invention.

In FIGS. 2 and 3, fuseblocks 60 and 62, incorporating the invention hereof, comprise base or body portions 64 and 66 that have respective top surfaces 76 and 78. Above surfaces 76 and 78, body portions 64 and 66 carry pairs of fuse clips 80, 82 and 84, 86 for retaining fuses thereon.

Fuseblocks 60 and 62 further include vertical sidewall portions 88A, 88B, 90A, 90B, and 92A, 92B, 94A, 94B forming opposed sidewalls that upstand from alongside the base or body portions. Although these sidewall portions are shown disconnected from one another, they could also be joined to form two solid sidewalls on opposite sides of the base or body portions.

Fuseblocks 60 and 62 further include joint means in the form of dovetail grooves and ridges for joining together like fuseblocks in side-by-side relationship. Fuseblock 60 presents a pair of dovetail ridges 100, 102 (FIG. 3) formed on the interior facing edges of a pair of ridges 104 and 106 joined to the side wall portions 90A and 90B at the ends 108, 110 thereof. Dovetail grooves 112, 114 are formed in the exterior facing edges of grooves 116, 118 formed in the sidewall poritons 88A, 88B at the ends 109, 111 thereof.

Fuseblock 62 provides like dovetail ridges 120, 122 on ridges 124, 126 joined to the outside surfaces of sidewall portions 92A, 92B. Fuseblock 62 also carries a pair of grooves 127, 128 that form dovetail grooves.

The grooves and ridges are aligned on the opposite sides of the fuseblocks so that they will engage or intermesh with the dovetail ridges and grooves of like fuseblocks by vertically sliding selectively in an upward or downward direction one fuseblock relative to another fuseblock. The dovetail ridges and grooves form dovetail joints that join the fuseblocks together against lateral forces. The alignments of the opposed grooves and ridges best can be seen in FIG. 3 where groove 100 is opposite ridge 112, and groove 102 is opposite ridge 114.

If either fuseblock 60 or 62 is fastened to a panel, another fuseblock can be joined thereto by aligning the grooves and ridges of the two fuseblocks and lowering the fuseblock to engage the grooves and ridges therebetween. This facilitates joining or engaging fuseblocks together on either side thereof without having to unfasten any fuseblocks from a mounting panel.

To guide the dovetail ridges of one fuseblock into engagement with the dovetail grooves of another fuseblock, the joint structures or means provide pilots. In fuseblock 60, ridges 104 and 106 converge upwardly in pilot ridges or portions (not shown) and grooves 116 and 118 diverge upwardly in pilot grooves or portions 117 and 119. In fuseblock 62, ridges 124 and 126 converge upwardly in pilot ridges or portions 123 and 125 and grooves 127 and 128 diverge upwardly in pilot grooves or portions (not shown).

When fuseblock 60 overlies fuseblock 62 to engage the joint structures thereof, the pilot ridges 123 and 125 first enter grooves 116 and 118 to begin aligning or registering the joint structures. The pilot ridges guide the dovetail grooves 112 and 114 downwards to engagement with the dovetail ridges 120 and 122, even when the grooves and ridges cannot be seen by the installer. When the bottom of fuseblock 60 reaches the height of the top surface 78 of fuseblock body 66, the dovetail grooves and ridges begin to engage; engagement becomes complete when fuseblock 60 rests fully alongside or flush with fuseblock 62.

When fuseblock 62 overlies fuseblock 60 to engage the joint structure thereof, the pilot grooves 117 and 119 first receive the ridges 124 and 126 to begin aligning or registering the joint structure. The pilot grooves guide the dovetail ridges 124 and 126 downwards to engagement with the dovetail grooves 114 and 116, even when the grooves and ridges cannot be seen by the installer. When the bottom of fuseblock 62 reaches the height of the top surface 76 of fuseblock body 64, the dovetail grooves and ridges begin to engage; engagement becomes complete when fuseblock 62 rests fully alongside or flush with fuseblock 60.

Although the pilot grooves and ridges extend upwardly the complete height of the sidewall portions of the fuseblocks, their respective upwardly diverging and converging shapes provide more than necessary draft for removing the fuseblocks from a mold in which they are formed.

Fuseblocks 60 and 62 further include end walls 130, 132 and 134, 136 that slide in tracks such as 140, 142 (FIG. 3) molded in the sidewalls to mount the end walls therein. These end walls substantially completely close off the fuse clips, fuses and electrical connections thereto from possible accidental intrusion from the ends of th fuseblock while providing ready access for connection to the clips when they are removed.

Lastly, fuseblocks 60 and 62 include detent means that lock the fuseblocks in vertical position when the dovetail groove and ridge joint means are engaged. These detent means carried on fuseblock 60 include locking tabs 144, 146 and channels 148, 150 that receive and mate with aligned, outwardly extending locking tabs 152, 154 on fuseblock 62. Fuseblock 60 also carries a pair of outwardly extending locking tabs 156 and 158 similar to tabs 152, 154. Thus when the two fuseblocks are joined together with the dovetail groove and ridge means, locking tabs 144 and 154 will engage with one another, and locking tabs 146 and 152 will engage with one another to maintain the fuseblocks in vertical position. The locking tabs and locking tabs in the channels are provided along the sides of the body portions of each fuseblock. In particular, locking tabs 144, 146, 152 and 154 are arranged so that in detented operating position tab 144 will abut against the top of tab 154, and tab 146 will abut against the bottom of tab 152. This over and under, and under and over abutment positively retains the fuseblocks in desired vertical position.

Figure 4:
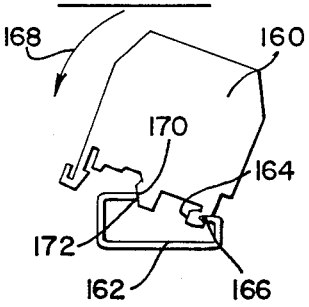
FIG. 4 PRIOR ART
FIG. 4 is an elevational view of a prior fuseblock being mounted on a channel member in one position.

In FIG. 4, a known fuseblock 160 mounts on a known channel 162. A lower lip 164 of the fuseblock engages with an edge 166 of the channel and the fuseblock 160 is rotated counterclockwise, indicted by arrow 168, to snap a bottom middle lip 170 into engagement with another edge 172 of the channel member 162.

Figure 5:
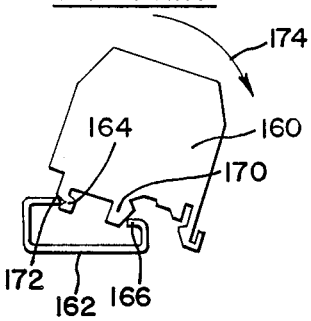
FIG. 5 PRIOR ART
FIG. 5 is an elevational view of a prior fuseblock being mounted on a channel member in another position.

In FIG. 5, fuseblock 160 mounts on channel member 162 in a different orientation. Front lip 164 engages with the other edge 172 of the channel member while the middle lower lip 170 of the fuseblock engages with the lower lip 166 of the channel member 162. This occurs by clockwise rotation of the fuseblock 160, indicated by arrow 174.

Figure 6:
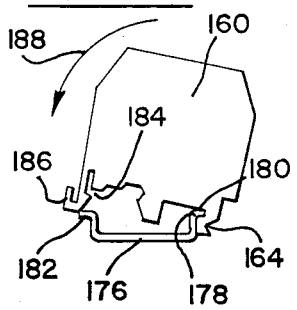
FIG. 6 PRIOR ART
FIG. 6 is an elevational view of a prior fuseblock being mounted on another channel member in one position.

In FIG. 6, fuseblock 160 mounts on channel member 176 by edge 178 of the channel member engaging in side pocket 180 above and inside of front lip 164. The other edge 182 of channel member 176 engages in pocket 184 of fuseblock 160 above and inside of rear lip 186. This engagement occurs by counterclockwise rotation of fuseblock 160 indicated by arrow 188.

Standard fuseblock 160 thus has a lower configuration adapted to complement and engage with two different channel members 162 and 176. It would be beneficial if the fuseblocks 60 and 62 of the invention could be adapted to mount on channel members such as 162 and 176 while using the dovetail groove and ridge joint means and detent means to maintain the fuseblocks joined together along the channel members.

Figure 7:
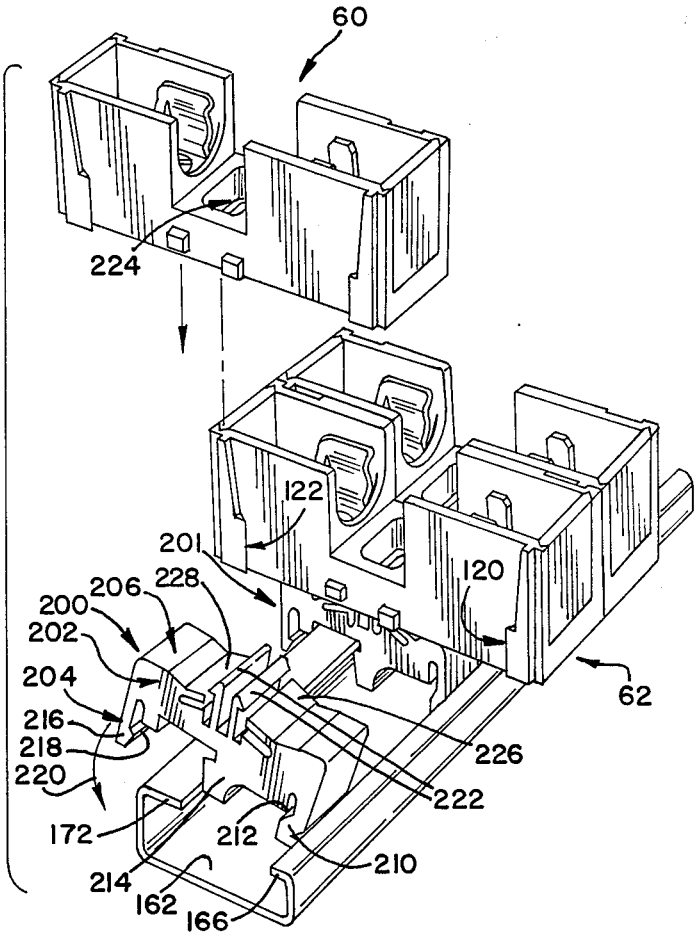
FIG. 7 is a perspective view of adapters of the invention mounting the fuseholders of the invention on a channel member with the fuseholders being joined together.

Referring to FIG. 7, the invention achieves the mounting of fuseblocks 60 and 62 on channel member 162 through the intermediary of adapter means embodied in adapters 200 and 201 of like construction. Adapter 200 has a central portion 202, a channel member engagement lower portion 204 and a body engagement upper portion 206. Channel member engagement lower portion 204 includes a lower front lip 210 having a pocket 212 therebehind, a bottom middle lip 214 and a lower rear lip 216 with a pocket 218 therebehind. Adapter 200 engages with channel member 162 by counterclockwise rotation indicated by arrow 220. Central portion 202 comprises the body of adapter 200. Upper engagement body portion 206 comprises a pair of upstanding fingers 222 extending the width of the adapter and terminating in top bevelled surfaces and adjoining latching surfaces (not separately identified for clarity of the drawing) that engage with like surfaces in the bottomly opening port 224 in fuseblock 60. Leaves 226 and 228 act as cantilevered spring members to retain the fuse holder 60 on the fingers 222.

After the adapter has been mounted on the channel member 162 through rotational movement thereof, the fuseblock 60 is translationally mounted on the adapter by pressing it down upon adapter 200 so that the fingers 222 pass through the opening 230 (FIG. 3) at the bottom of port 224 and so that the downwardly facing latching surfaces at the tips of the fingers 222 engage against the upwardly facing surfaces 232 (FIG. 3) at the bottom of the port 224 surrounding opening 230. Additionally, the downwardly rectilinear movement of fuseblock 60 engages the dovetail grooves thereof (not shown) with the dovetail ridges 120, 122 of fuseblock 62 to obtain the previously described dovetail engagement thereof through the aid of the pilots.

Adapter 200 thus cooperates with fuseblocks 60 and 62 and the dovetail groove and ridge joint means thereof in providing a fuseblock assembly that readily can be mounted on either a flat panel or channel member and that can be joined to adjacent fuseblock assemblies by integral dovetail joints. The pilot portions of the grooves and ridges facilitate this engagement.

The material of the fuseblock and adapter can be any insulating material desired that is readily moldable and provides the desired insulating qualities for a particular application.

Modifications and variations of the present invention are possible in light of the above teachings. For example, the configuration of the channel member engagement lower portion of the adapter can be changed to complement the cross section of any desired channel member. Additionally, the specifics of the location of the dovetail grooves and ridges can be reversed or altered while achieving the ability to join two fuseblocks from above on either side of a mounted fuseblock. The dovetails of the pilot portions can be modified as desired. Also, the details of the latching surfaces at the tips of the fingers upstanding from the adapter can be modified as desired, and the fingers can be replaced with a simple fastener such as a headed screw. The fingers, however, obviate any need for additional fasteners such as a headed screw. Lastly, the detent means can be modified or eliminated as desired to obtain vertical retention of the fuseblocks after they are joined together vertically. It is therefore, to be understood that within the scope of the appended claims, the invention can be practiced otherwise than as specifically described.

I claim:

1. A modular fuseblock for retaining a fuse therein and adapted to be joined with other like modular fuseblocks in side-by-side relationship, said modular fuseblock comprising:

A. a body of insulating material including a base having a top surface and a pair of side walls upstanding from alongside said base;

B. a pair of fuse clips secured to said top surface of said body between said pair of side walls; and C. joint means open to the top and bottom of said body for joining together plural like fuseblocks in side-by-side relationship from the top on both sides of said body, said joint means including at least two dovetail grooves vertically arranged on one of said side walls and at least two dovetail ridges vertically arranged on the other of said side walls, said dovetail grooves and ridges being aligned so that the dovetail ridges on one fuseblock will engage with the dovetail grooves on an adjoining fuseblock by vertically sliding selectively in an upward or downward direction therein to join together the two fuseblocks, and said dovetail grooves and ridges being accessible from both the top and bottom of said body to facilitate downward joining of one fuseblock on another fuseblock at both side walls of the fuseblocks.

2. A modular fuseblock for retaining a fuse therein and adapted to be joined with other like modular fuseblocks in side-by-side relationship mounted on a flat panel or a channel member, said modular fuseblock comprising:

A. a body of insulating material including a base having a bottom surface and a top surface, and a pair of sidewalls upstanding from alongside said base, said base also presenting a port opening to said top and bottom surfaces selectively for mounting said body on said flat panel or channel member;

B. at least two fuse clips secured to the top surface of said body between said pair of side walls;

C. joint means for joining together plural like fuseblocks in side-by-side relationship, said joint means including at least two dovetail groves vertically arranged on one of said side walls and at least two dovetail ridges vertically arranged on the other of said side walls, said dovetail grooves and ridges being aligned so that the pair of ridges on one fuseblock will engage with the dovetail grooves on an adjoining fuseblock by vertically sliding selectivley in an upward or downward direction therein to join together the two fuseblocks, and said dovetail grooves and ridge being accessible from both the top and bottom of said body to facilitate downward joining of one fuseblock on another fuseblock at both side surfaces of the fuseblocks; and D. adapter means selectively engageable with said body for mounting said body on said channel member, said adapter means including a central portion, a channel member engaging lower portion and a body engaging upper portion, said lower portion presenting a configuration complementary to the configuration of said channel member and being adapted to mate therewith through rotational movement of said adapter means relative to said channel member and fasten said lower portion to said channel member, said upper portion presenting a configuration complementary to said bottom surface and port of said body and adapted to mate with said bottom surface and port of said body through vertical translational movement of said body onto said upper portion, said adapter means including fastener means adapted for fastening said fuseblock to said channel member, and said vertical translational movement of said body onto said upper portion providing for said joining together plural like fuseblocks in side-by-side relationship through said joint means.

3. The fuseblock of claims 1 or 2 in which said joint means include at least two ridges joined to an extending the complete height of one side wall and the confronting edges of said at least two ridges defining said at least one dovetail ridges, said joint means further including at least two grooves formed in and extending the complete height of the other side wall and the edges of said at least two grooves defining said dovetail grooves.

4. The fuseblock of claim 3 in which said dovetail grooves and ridges are spaced toward the end of said body to distribute forces therebetween across the length of said body.

5. The fuseblock of claims 1 or 2 which said dovetail groves and ridges extend vertically substantially the height of only said body portion.

6. The fuseblock of claims 1 or 2 including detent means for retaining joined fuseblocks in fixed vertical position, said detent means including a pair of locking tabs on each side wall of the fuseblock body arranged to engage tabs of an adjoining fuseblock in under and over relationship.

7. The fuseblock of claim 6 in which said detent means further include channels on one side wall of said body in which are mounted the pair of locking tabs on that side wall of the body.

8. The fuseblock of claims 1 or 2 including at least one end wall extending between said side walls and the end of said body to protect against intrusion on said clips, said side walls including tracks and the edges of said end walls being retained in said tracks for vertical movement therein.

9. The fuseblock of claim 2 in which said body includes a port opening to the top and bottom of said body and having a pair of upwardly facing latching surfaces on opposed sides of said bottom opening, and said fastener means include a pair of fingers adapted to extend through said bottom opening into said port and the tops of said fingers present a pair of downwardly facing latching surfaces adapted to engage against said upwardly facing latching surfaces.

10. The fuseblock of claim 9 in which said fastener means include a pair of leaves extending upwardly from the top of said adapter means and acting as a pair of canilevered springs for maintaining said latching surfaces engaged against one another.

11. The fuseblock of claim 2 in which said adapter means extends substantially the width of said body.

12. The fuseblock of claims 1 and 2 including pilot means for guiding the joint means of two fuseblocks into engagement with one another.

13. The fuseblock of claim 3 including pilot means extending from the dovetail grooves and ridges on said fuseblock for guiding the at least two dovetail ridges on one fuseblock into engagement with the at least two dovetail grooves of a like fuseblock.

14. The fuseblock of claim 13 in which said pilot means include pilot portions of said ridges extending upwardly from said dovetail ridges and converging therefrom and pilot portions of said grooves extending upwardly from said dovetail grooves and diverging therefrom.

15. An adapter for mounting a fuseblock on a channel member with the length of the fuseblock oriented transverse of the length of the channel member, the fuseblock including a body and a mounting port extending through said body from an opening in the bottom surface of said body to an opening in the top surface of said body, said adapter comprising:

a central portion, a channel member engaging lower portion and a fuseblock engaging upper portion, said lower portion presenting a configuration complementary to the configuration of said channel member and being adapted to mate therewith through rotational movement of said adapter relative to said channel member and fasten said lower portion to said channel member, said upper portion presenting a configuration complementary to said bottom surface and said mounting port and being adapted to mate therewith through translational movement of said fuseblock, said upper portion including integral fastener means adapted for passing through said mounting port and fastening said fuseblock to said adapter.

16. The adapter of claim 15 in which said port furnishes a pair of upwardly facing latching surfaces on opposed sides of said top opening, and said fastener means include a pair of fingers adapted to extend through said port and the tips of said fingers present downwardly facing latching surfaces adapted to engage against said upwardly facing latching surfaces.

17. The adapter of claim 16 in which said fastener means include a pair of leaves extending upwardly from the top of said adapter means and acting as a pair of cantilevered springs for maintaining said latching surfaces engaged against one another.

18. The adapter of claim 15 in which said adapter is means adapted to extend substantially the width of the body of said fuseblock.

* * * * *